US005291872A

United States Patent [19]

Ghaem

[11] Patent Number: 5,291,872

[45] Date of Patent: Mar. 8, 1994

[54] IGNITION APPARATUS FOR AN INTERNAL COMBUSTION ENGINE

[75] Inventor: Sanjar Ghaem, Palatine, Ill.

[73] Assignee: Motorola, Schaumburg, Ill.

[21] Appl. No.: 908,272

[22] Filed: Jul. 2, 1992

[51] Int. Cl.[5] ..... F02P 3/12

[52] U.S. Cl. ..... 123/620; 123/633; 123/642; 310/339; 315/55; 315/209 PZ; 361/254; 361/260

[58] Field of Search ..... 123/642, 633, 620, 169 PA, 123/169 PH; 361/260, 254; 315/55, 209 PZ; 310/339

[56] References Cited

U.S. PATENT DOCUMENTS

| | | | |
|---|---|---|---|
| 995,400 | 6/1911 | Cavanagh . | |
| 1,011,884 | 12/1911 | Cavanagh . | |
| 2,069,046 | 1/1937 | Rabezzana | 123/169 |
| 2,621,312 | 12/1952 | Mascuch | 315/46 |
| 3,076,113 | 1/1963 | Candelise | 313/135 |
| 3,094,108 | 6/1963 | Small et al. | 123/642 |
| 3,128,139 | 4/1964 | Estes | 439/126 |
| 3,173,055 | 3/1965 | Harkness | 315/55 |
| 3,178,661 | 4/1965 | Kirchgessner | 333/182 |
| 3,202,873 | 8/1965 | Feldman | 315/209 |
| 3,212,044 | 10/1965 | Cloud, Jr. | 338/66 |
| 3,215,133 | 11/1965 | Farrell | 123/642 |
| 3,229,153 | 1/1966 | Freeman, Jr. | 315/55 |
| 3,261,339 | 7/1966 | Quinn | 123/642 |
| 3,355,623 | 11/1967 | Konopa | 315/55 |
| 3,397,683 | 8/1968 | Phillips | 123/642 |
| 3,622,717 | 11/1971 | Hoover | 200/23 |
| 3,716,038 | 2/1973 | Bevacqua | 123/634 |
| 3,737,691 | 6/1973 | Hoover | 310/339 |
| 3,826,952 | 7/1974 | Iwasaki et al. | 361/260 |
| 3,865,539 | 2/1975 | Burge, Jr. et al. | 431/255 |
| 4,001,615 | 1/1977 | Berlincourt | 310/339 |
| 4,095,580 | 6/1978 | Murray et al. | 123/297 |
| 4,139,792 | 2/1979 | Kondo | 310/339 |
| 4,269,161 | 5/1981 | Simmons | 123/620 |
| 4,287,862 | 9/1981 | Noguchi et al. | 123/310 |
| 4,297,609 | 10/1981 | Hirao et al. | 310/339 |
| 4,301,782 | 11/1981 | Wainwright | 123/620 |
| 4,393,850 | 7/1983 | Nishida et al. | 123/536 |
| 4,412,151 | 10/1983 | Norris | 315/55 |
| 4,497,532 | 2/1985 | Bezuski et al. . | |
| 4,767,967 | 8/1988 | Tanaka et al. | 310/339 |
| 4,917,060 | 4/1990 | Harada et al. | 123/179.5 |
| 5,095,242 | 3/1992 | Richeson | 313/143 |

FOREIGN PATENT DOCUMENTS

| | | | |
|---|---|---|---|
| 56-56965 | 5/1981 | Japan | 123/633 |
| 58-122361 | 7/1983 | Japan | 123/642 |

*Primary Examiner*—Andrew M. Dolinar

*Attorney, Agent, or Firm*—Phillip H. Melamed; John H. Moore

[57] ABSTRACT

An ignition apparatus for providing energy to a spark plug (601) is described including electromagnetic means (121, 103, 133, 119) having a north pole (137) and an opposing south pole (139). A piezoelectric crystal (129) is located between the north pole (137) and the opposing south pole (139). The electromagnetic means (121, 103, 133, 119) compresses the piezoelectric crystal (129), thereby causing an ignition energy to be provided from the piezoelectric crystal (129) for igniting the spark plug (601).

31 Claims, 6 Drawing Sheets

IGNITION APPARATUS FOR AN INTERNAL COMBUSTION ENGINE

FIELD OF THE INVENTION

This invention is generally directed to the field of ignition apparatus and particularly to ignition apparatus for providing ignition energy to a spark plug for igniting fuel in an internal combustion engine.

BACKGROUND OF THE INVENTION

In conventional, or regenerative ignition systems, a voltage multiplier and storage device, typically an autotransformer, is cyclically charged from a battery. The stored energy is then distributed to a spark plug through a resistive cable and depleted across a spark gap providing ignition of an air-fuel mixture. Although widely applied, this type of ignition system has many undesirable characteristics. These include; significant energy losses due to the inefficiency of the autotransformer and resistive cable, the transmission of high voltage and energy across a significant distance providing substantial electromagnetic wave emissions, the short reliable life of the autotransformer and resistive cable, the power burden the autotransformer induces on its driving circuitry, the varied quality of the energy delivered to the spark plug due to parametric variation of the autotransformer characteristics, and weight and size of the autotransformer.

Some have attempted to solve some of these problems by providing individual autotransformers mounted on or near each spark plug. This approach still suffers from; significant energy losses due to the inefficiency of the autotransformer, the short reliable life of the autotransformer, the power burden the autotransformer induces on its driving circuitry, the varied quality of the energy delivered to the spark plug due to parametric variation of the autotransformer characteristics, and weight and size of the autotransformer.

Yet others have suggested the use of piezoelectric ignition elements in distributors and individual spark plug applications. One such patent is U.S. Pat. No. 4,412,151, issued Oct. 25, 1983 to Elwood G. Norris. While overcoming the losses inherent to autotransformers these approaches, including the Norris patent, have other problems. For instance, a piezoelectric crystal can generate the required high voltage necessary to ignite a spark gap, however, especially with the advent of lean burn requirements, the ignitable air-fuel ratio's require substantially more energy than a piezoelectric crystal can supply. Additionally, these piezoelectric elements have been driven by energy wasting or inaccurate methods. For instance, piezoelectric elements have been driven by mechanized striking mechanisms. The mechanical type strikers do not compensate for wear and are therefore inaccurate. The electromechanical strikers waste energy to overcome the inertia of a striking mechanism.

All of these approaches suffer from poor efficiency and still have substantial electromagnetic wave emissions.

Earlier attempts at providing electromagnetic shielding on ignition system components have been expensive and difficult to manufacture. An example of an electromagnetic shield is illustrated in U.S. Pat. No. 3,128,139, issued Apr. 7, 1964 to S. E. Estes. The Estes patent shows a tubular electrically conductive housing 13 surrounding an elastomeric boot 20 and is grounded to a hexagonal shoulder 14 of a spark plug 11 by a spring clip 29. This is a complex assembly requiring many individual parts and is difficult to manufacture.

Finally, it's important to note that the operating environment for ignition system components is very hostile from a thermal, vibration and chemical aspect. These components must operate above 135° Celsius, to below 40° Celsius and will be subjected to oil, gasoline, antifreeze, brake fluid, water, salt and other highly corrosive chemicals. The vibration can exceed 5 Gs in 3 axes with transients to thousands of G's. Operating on weighty and bulky components this vibration is fatal. The combination of the vibration, chemicals and thermal range reduces the reliable life of ignition components significantly.

In summary, prior art approaches have many deficiencies including; energy inefficiency, substantial electromagnetic radiation, short reliable life, excessive power burden on the driving circuitry, varied quality of energy provided to the spark gap, lack of sufficient energy for lean burn requirements, excessive weight and size, and insufficient sealing.

What is needed is a considerably smaller, lighter weight, low electromagnetic wave emission, high power, sealed, reliable, high quality of energy, and energy efficient ignition system for internal combustion engines.

SUMMARY OF THE INVENTION

An ignition apparatus for providing energy to a spark plug is described including electromagnetic means having a north pole and an opposing south pole. A piezoelectric crystal means is located between the north pole and the opposing south pole. The electromagnetic means, in response to electrical excitation, compresses the piezoelectric crystal means, thereby causing an ignition energy to be provided from the piezoelectric crystal means for igniting the spark plug.

DETAILED DESCRIPTION OF A PREFERRED EMBODIMENT

A solution to the problems described in the background is to generate the necessary energy physically close to a spark plug in a compact sealed package, while minimizing any electromagnetic radiation. This is accomplished by breaking down the energy provision problem into component elements.

To ionize gas in a spark plug gap, an energy source having a very high voltage is necessary to overcome the gap's very high resistance to current flow. Once the gap is ionized, thus conducting, the resistance to current flow is very low. It is this initial ionization of the gap that ignites an air-fuel mixture in a cylinder. Typically, the time it takes to ionize the gas in the spark plug gap is about 1 to 10 microseconds. This time may be more or less depending on the physical characteristics of the elements involved. To continue conduction of the gap, for providing sufficient electrical energy to continue burning the air-fuel mixture, current must continue to flow for about an additional 100 microseconds to several milliseconds. This time may be more or less depending on the physical characteristics of the elements involved. However, since the gap's resistance to current flow is very low, a source resistance of the energy source must be substantially low in order to provide the necessary energy. During this second period the voltage across the gap is measured in tens to hundreds of volts. This voltage may be more or less depending on the physical characteristics of the elements involved.

Figure 6:
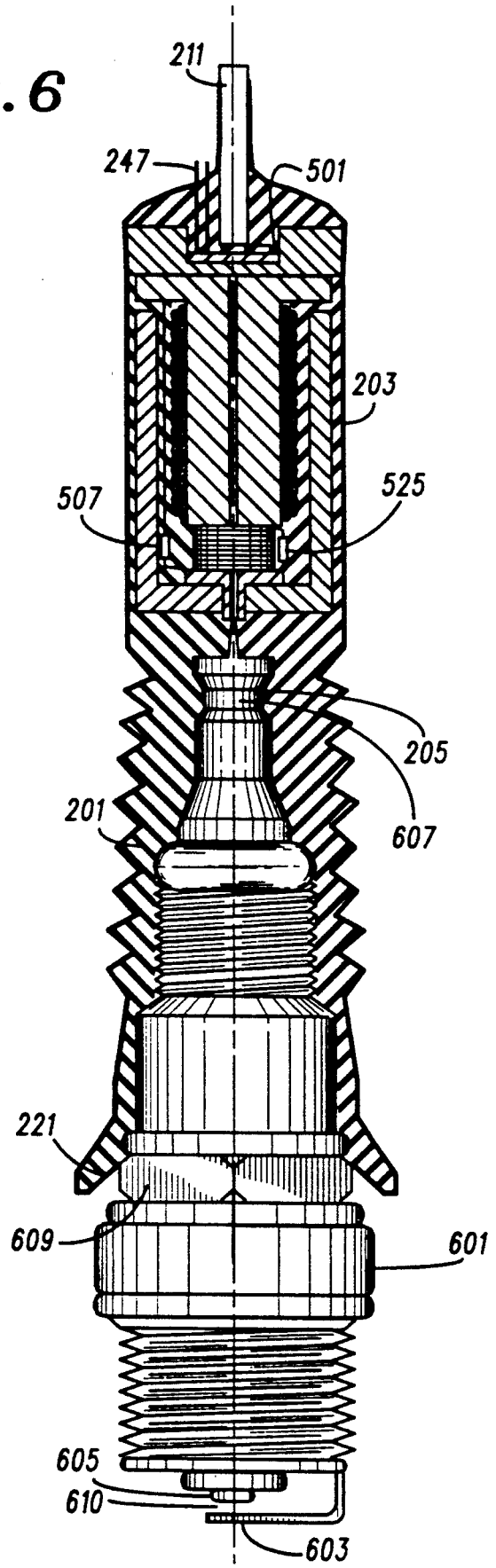
FIG. 6 is a cross section of the apparatus shown in FIG. 5 assembled and attached to a spark plug.

By combining a piezoelectric crystal, integral to a magnetic field of an electromagnetic device to generate an ignition voltage, and a sustaining voltage supply, to provide necessary sustaining energy, an improved apparatus for igniting and burning air-fuel mixtures in an internal combustion engine is detailed below. It is imperative while reading this description to remember the need to restrict any electromagnetic radiation emissions from the apparatus. The completed apparatus is illustrated in FIG. 6 and is coupled to and driving a spark plug 601. Note that the spark plug 601 has a spark gap 610, an anode terminal 605, electrically connected to a positive terminal 607, and a cathode terminal 603, electrically connected to a negative terminal 609.

The apparatus will be described in its component parts. First, the electromagnetically excited piezoelectric ignition voltage generator is detailed. Later the electromagnetic shielding and sustaining voltage supply will be detailed.

It is a well-known principal that compressing a piezoelectric crystal will enable it to generate a high voltage, on the order of hundreds of volts, across itself. By stacking a multitude of these crystals end-to-end a very high voltage can be obtained.

Figure 1:
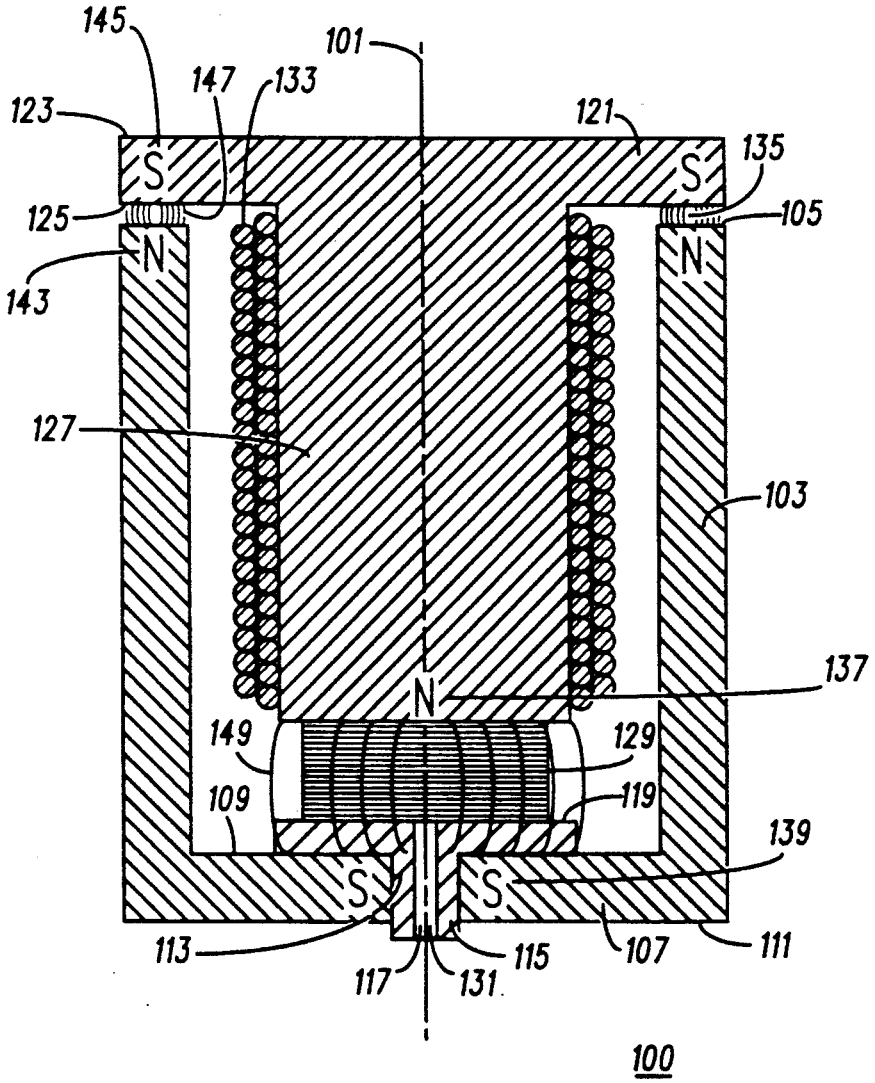
FIG. 1 is a cross section of an ignition generator, in accordance with the invention.

In FIG. 1 a cross section of an ignition generator is illustrated. A cup core 103 having a predetermined diameter is provided for housing a stack of piezoelectric crystals 129. The cup core 103 is predominantly tubular and has an open end bounded by a top edge 105 and a substantially closed end 107. For reference purposes the cup core 103 is shown oriented along an axis 101. The substantially closed end 107 has an inside surface 109 and an opposing outside surface 111 with an aperture or opening 113 disposed therein. The aperture 113 has a predetermined diameter, smaller than the predetermined diameter of the cup core 103. The aperture 113 emanates away from the axis 101 and originates on the inside surface 109 and continues to the opposing outside surface 111.

To electrically isolate the stack of piezoelectric crystals 129 from the cup core 103 an insulating spacer 115 is provided. In the preferred embodiment a ceramic material is used. Those of ordinary skill in the art will recognize other suitable materials as a substitute for ceramic. It is important to not that in addition to being insulating this material must be substantially non-compressible. If the material compressed the resulting damping action would limit the voltage output from the stack of piezoelectric crystals 129. The insulating spacer 115 is disposed on the inside surface 109 of the cup core 103 and protrudes through the aperture 113 and extends away from the opposing outside surface 111 of the substantially closed end 107 of the cup core 103. Further, the insulating spacer 115 has a feedthrough aperture 117 disposed therein, emanating away from the axis 101 and originating away from the opposing outside surface 111 of the cup core 103 and continuing to a top surface 119 of the insulating spacer 115. This feedthrough aperture 117 has a conductive material 131 disposed thereon for conducting energy generated from the stack of piezoelectric crystals 129 and will be connected to the positive terminal 607 of the spark plug 601 as shown in FIG. 6. Note that the electrical connection to the negative terminal 609 of the spark plug 601 will be described later.

A ferrite core element 121 is provided next. The ferrite core element 121 has a top surface 123, and an opposing bottom surface 125. The surfaces 123 and 125 are located parallel to, and the opposing bottom surface 125 spaced apart from, the top edge 105 of the cup core 103. This construction provides an electrically insulating gap 135. A cylindrical protruding member 127 extends away from the opposing bottom surface 125 parallel to the axis 101. The ferrite core 121 includes a conductor 133 disposed as a plurality of windings thereon.

The stack of piezoelectric crystals 129 is disposed between the top surface of 119 the insulating spacer 115 and the cylindrical protruding member 127 of the ferrite core 121. Note that the stack of piezoelectric crystals 129 are provided in a configuration that yields a maximum output voltage for a given compression.

Upon electrical excitation of the conductor 133 surrounding the ferrite core 121, a magnetic field is provided including; the ferrite core 121, the electrically insulating gap 135, the cup core 103, the insulating spacer 115, and the stack of piezoelectric crystals 129. The magnetic field causes the ferrite core 121 to attract towards the cup core 103 thereby compressing the stack of piezoelectric crystals 129 and providing energy. This energy will be used to ignite the spark gap 610 of the spark plug 601 shown in FIG. 6. This energy, or ignition voltage, is in the form of a very high voltage with a limited energy. Returning to FIG. 1, the magnetic field is shown traversing the electrically insulating gap 135 by reference number 147 and normally intersecting the stack of piezoelectric crystals 129 by reference number 149.

Those of ordinary skill in the art will recognize many variations of electromagnetic compressors. However, it is important to note the efficiency of this particular design. This is due to several factors. First, the stack of piezoelectric crystals 129 is located within the magnetic field. The flux lines 149 are shown to intersect the stack of piezoelectric crystals 129 in a normal, or perpendicular, orientation. This results in no coupling loss, which would be expected if the stack of piezoelectric crystals 129 was compressed external to the magnetic field. Second, the flux lines 147, intersecting the insulating gap 135 between the opposing bottom surface 125 of the ferrite core 121 and the top edge of the cup core 103, have a large surface area over which to conduct. Because of the relatively small distances these flux lines 149, 147 need to transit, and the relatively large surface areas provided for conduction 125, 105, 103, 109, 127, and 121, the flux lines are substantially straight. This means there is very low loss in the electromechanical transformation of electrical energy into mechanical displacement. This results in a design that is volumetrically efficient, which is an important factor when mounting on a spark plug 601, shown in FIG. 6. Returning to FIG. 1, the cup core 103 and ferrite core 121 elements provide an electromagnetic shield around the stack of piezoelectric crystals 129 thereby reducing any electromagnetic emissions generated by the stack of piezoelectric crystals 129. This is because the ferrite material is lossy at the high frequencies of concern.

Next the electrical connection to the spark plug 601, as shown in FIG. 6, and the external electromagnetic shield are described.

Figure 2:
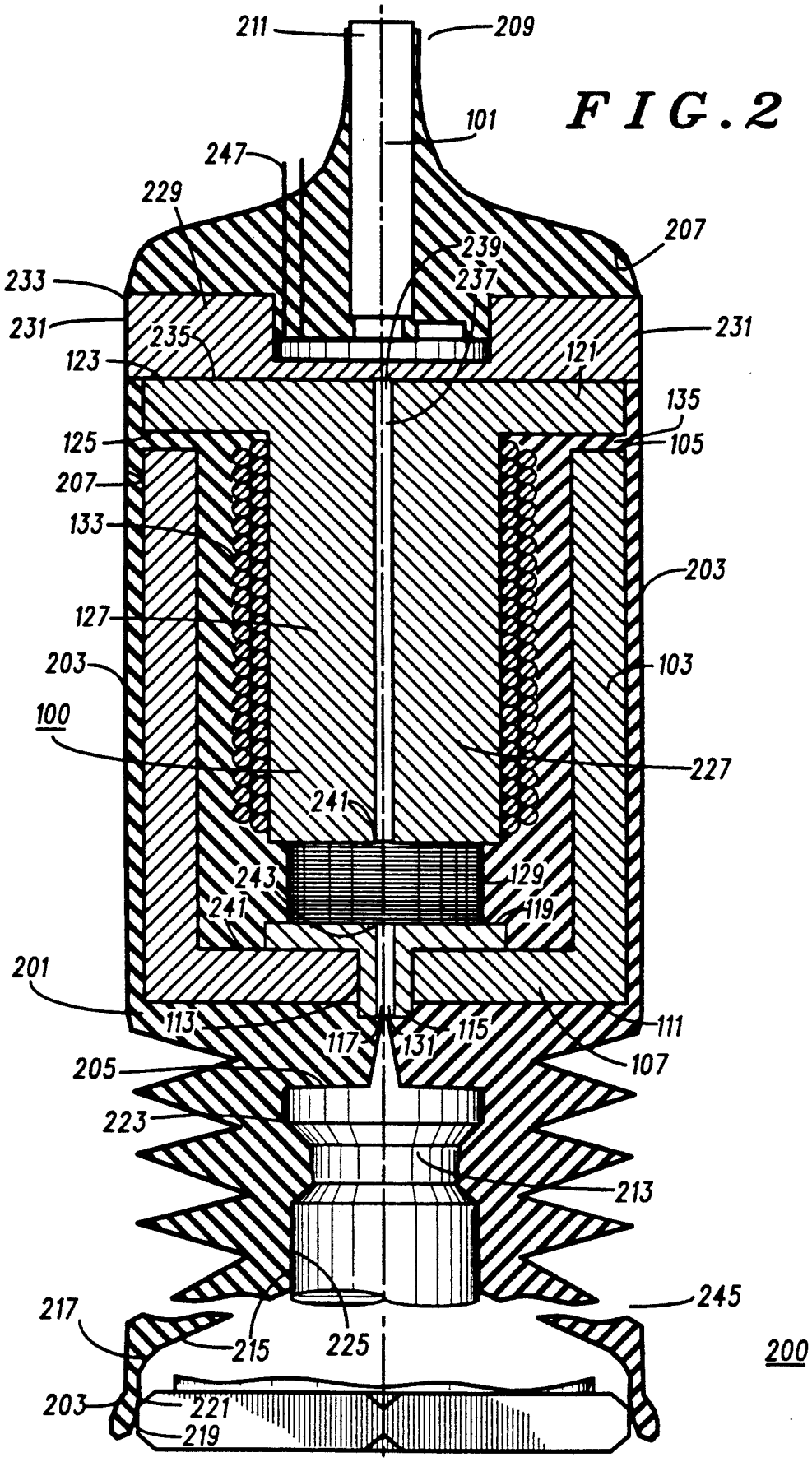
FIG. 2 is a cross section of the ignition generator in FIG. 1 housed in an electromagnetically shielded elastomeric boot assembly.

FIG. 2 illustrates a cross section of the ignition generator 100 from FIG. 1 housed in an elastomeric boot assembly. A substantially tubular elastomeric boot 201 encapsulates the ignition generator 100. In the preferred embodiment this boot 201 is constructed with a silicone material. Of course, any other material having substantially similar performance characteristics can be substituted. The boot 201 has an exterior surface 207 with a conductive material 203 disposed thereon. In the preferred embodiment this conductive material is a Wacker silver filled silicone material. Since this material is silicone based it is easily applied to the silicone boot 201. This conductive material 203 forms an electromagnetic shield surrounding the ignition generator 100. This, in effect, is a second shield adjunct to the electromagnetic shield formed by the cup core 103 and ferrite core 121 of the ignition generator 100. The boot 201 has a cable end portion 209 for receiving an ignition cable 211, and a plug portion 213. The plug portion is for receiving the to be provided spark plug 601, of FIG. 6. Returning to FIG. 2, note that in this illustration at reference number 245 the boot 201 is sectioned. This is done in order to highlight the construction of the boot 201 in the area of the ignition generator 100. A complete boot 201 is shown in FIG. 6. Returning to FIG. 2, the plug portion 213 has an interior surface 215 with a negative mating area 217. The negative mating area 217 has a conductive material 219 disposed thereon. This the same Wacker silver filled silicone material as used for the coating 203. The conductive material 219 is electrically connected to the conductive material 203 disposed on the exterior surface 207 of the boot 201. The conductive material 219 disposed on the negative mating area 217 provides a negative terminal 221. The negative terminal 221 is to be connected to the negative terminal 609 of the spark plug 601, as shown in FIG. 6. Returning to FIG. 2, a positive mating area 223 has a conductive material 225 disposed thereon. This the same Wacker silver filled silicone material as used for the coating 203. The positive mating area 223 is located apart from and electrically isolated from the negative terminal 221. The conductive material 225 on the positive mating area 223 provides a positive terminal 205. The positive terminal 205 is to be connected to the positive terminal 607 of the spark plug 601, as shown in FIG. 6. Returning to FIG. 2, the boot 201 has an interior cavity portion 227 located between the cable end portion 209 and the plug portion 213 for housing the ignition generator 100.

An electrically conductive heatsink 229 is located on the disposed on a portion 235 of the top surface 123 of the ferrite core 121. The heatsink is used to provide an electrical connection and to sink heat from a circuit to be described later. This circuit includes the sustaining voltage supply and the driver for the conductor 133 surrounding the ferrite core 121. The heatsink 229 has selective portions 231 protruding through the exterior surface 207 of the boot 201. The selective portions 231 are electrically connected 233 to the conductive material 203 disposed on the exterior surface 207 of the boot 201.

In this figure the cylindrical protruding member 127 of the ferrite core 121 has conductive portion 237 disposed thereinto. This conductive portion 237 is electrically connected 239 to the heatsink 229. As mentioned earlier the conductive material 131 disposed on the feedthrough aperture 117 is composed of ABLESTICK 8175, an epoxy based adhesive with a conductive filler. Those of ordinary skill in the art will recognize other suitable materials as a substitute for this material.

In the preferred embodiment a dwell signal is provided to the circuitry in the boot 201 through an optical cable 211. Battery power, for powering the circuitry in the boot, is provided on the two terminals shown by reference number 247.

With the conductive material 219, 203, 225, the conductive heatsink 229 and the conductive material 237 an electrical path is now in place to deliver ignition energy from the ignition generator 100 to the spark plug 601 shown in FIG. 6. Returning to FIG. 2, upon electrical excitation of the conductor 133, the ferrite core 121 and the cup core 103 attract, thereby compressing the stack of piezoelectric crystals 129. This causes a very high voltage to be created across the stack of piezoelectric crystals 129. This voltage conducts through an electrical path including the electrically conductive material 131 of the aperture 117 in the insulating spacer 115, the positive terminal 205 of the boot 201, the positive terminal 607, the anode 605, the spark gap 610, the cathode 603, and the negative terminal 609 of the spark plug 601, the negative terminal 221 of the boot 201, the electrically conductive heatsink 229, and the conductive portion 237 disposed into the ferrite core 121.

The unique construction of this boot 201 provides; a seal around the ignition apparatus thereby minimizing the effects of chemical intrusion. It also provides for a reliable electrical and mechanical connection between the ignition apparatus and the spark plug 601, and an electromagnetic shield around the ignition apparatus thereby minimizing the electromagnetic emissions created during the ignition process. And finally, an electrical path for the ignition voltage.

The construction of the heatsink provides an electrical path for the ignition voltage, while providing for efficient thermal dissipation because of the protruding selective portions 231.

The optical cable 211 eliminates any electromagnetic wave emissions between the boot 201 and an ignition controller described later.

Next the sustaining voltage supply will be introduced along with the remaining electrical details of the ignition apparatus.

Figure 3:
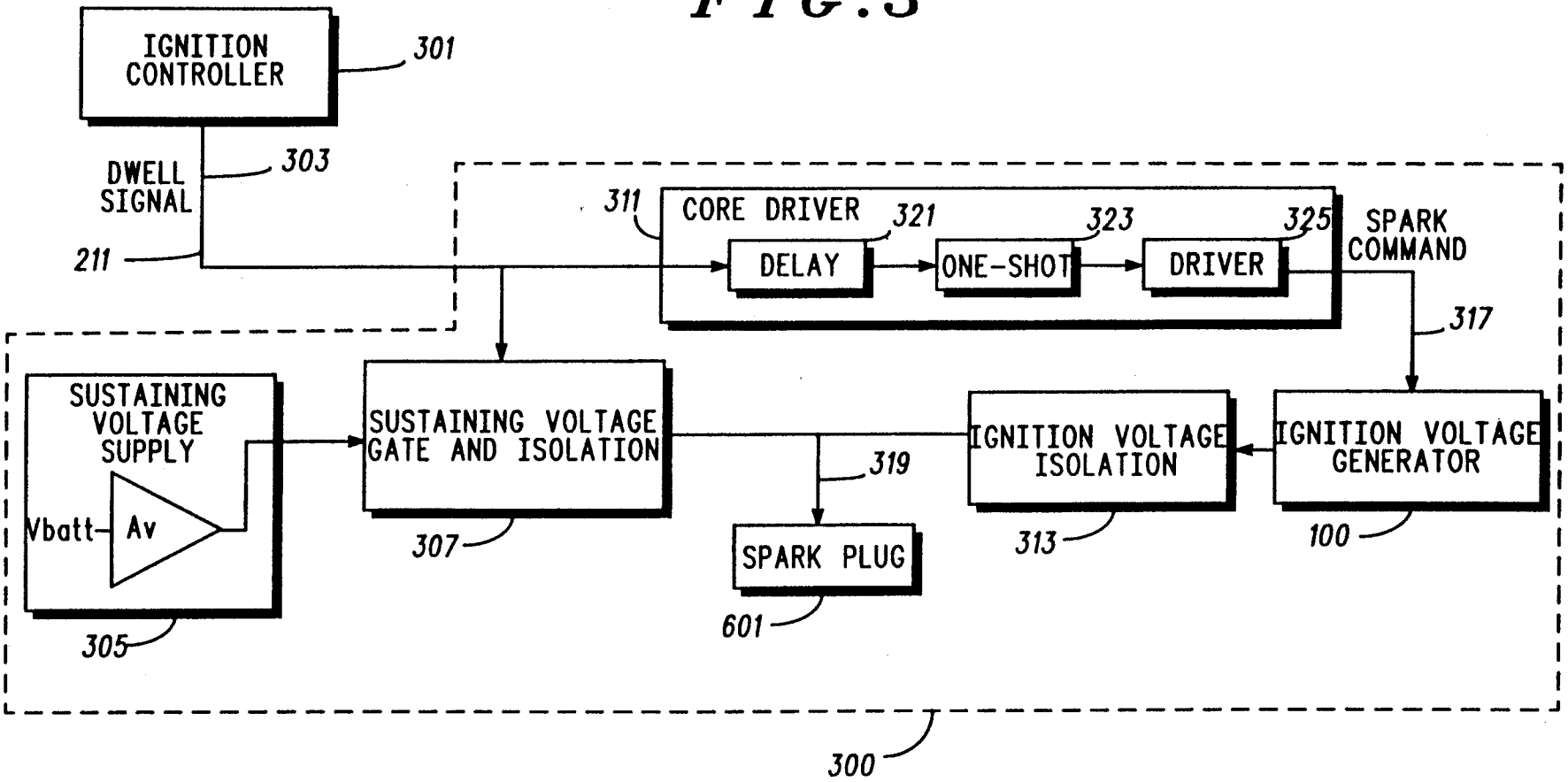
FIG. 3 is a schematic block diagram of a circuit for providing ignition and sustaining energy to a spark plug, in accordance with the invention.

FIG. 3 illustrates a schematic block diagram of a circuit for providing ignition and sustaining energy to a spark plug. An ignition controller 301 provides a dwell signal 303 through the optical cable 211 to an ignition circuit 300. The dwell signal 303 drives a core driver 311 and a sustaining voltage gate and isolation circuit 307. The core driver 311 is employed to energize the conductor 133 surrounding the ferrite core 121 thus creating the magnetic field between the ferrite core 121 and the cup core 103. The core driver 311 includes a delay circuit 321, a one-shot circuit 323, and a driver circuit 325. The need for these functions 321, 323, and 325 will become apparent with the introduction of FIG. 4 below. The core driver 311 outputs a spark command signal 317 that drives the conductor 133 surrounding the ferrite core 121. When commanded by the spark command 317 signal the ignition generator 100 generates a very high voltage. This is coupled via an ignition voltage isolation stage 313 to the spark plug 601. The ignition voltage isolation stage 313 is employed so that the ignition generator 100 is not electrically loaded by the sustaining voltage gate and isolation circuitry 307 when generating an ignition voltage.

The sustaining voltage gate and isolation circuit 307 is driven by a sustaining voltage supply 305. This sustaining voltage supply 305 is constructed with a voltage amplifier for amplifying a battery voltage to a level sufficient to sustain conduction of the spark plug 601 after ignition. The isolation circuit is required to protect the sustaining voltage gate from the ignition voltage generated by the ignition generator 100. The sustaining voltage gate and isolation circuit 307 provides the gated sustaining voltage to the spark plug 601 at the appropriate time. In order to ignite and sustain the spark gap 610 of the spark plug 601 the ignition and sustaining voltages must be applied and withdrawn in a particular sequence. Reference number 319 shows where the ignition voltage and the gated sustaining voltage are summed creating a spark plug voltage and applied to the spark plug 601. Responsive to a dwell signal the sustaining voltage must be provided first. Later the ignition voltage is applied to the spark gap 610. And finally the sustaining voltage is withdrawn after the air-fuel mixture in the cylinder is expended. The operation of the circuit in FIG. 3 will be clearer after considering the illustration in FIG. 4.

Figure 4:
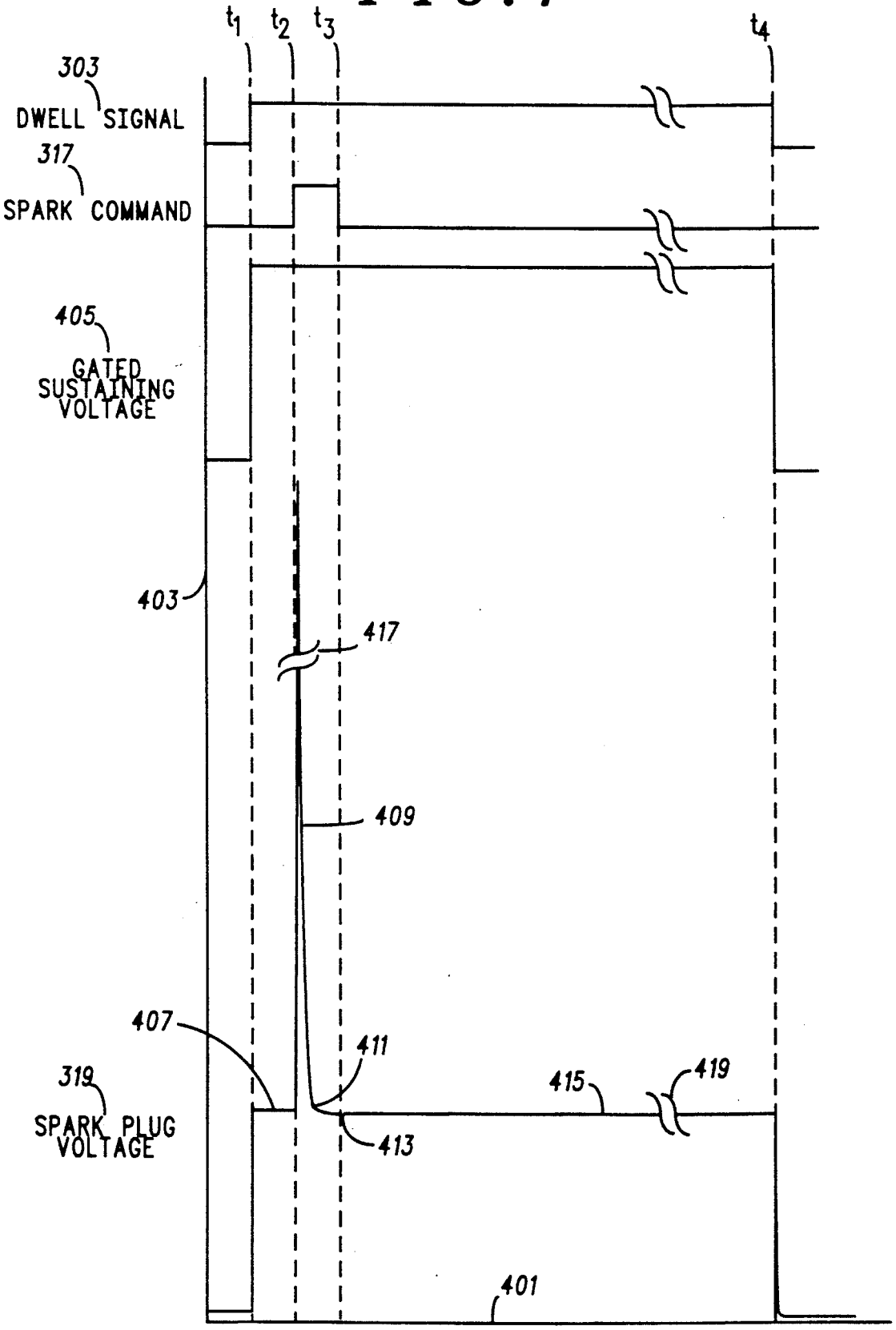
FIG. 4 is a chart of waveforms including typical waveforms found in the circuit described in FIG. 3.

FIG. 4 is a chart of waveforms including typical waveforms found in the circuit described in FIG. 3. The horizontal axis 401 represent time. On the vertical axis are several waveforms including; spark plug voltage 319, gated sustaining voltage 405, spark command 317, and the dwell signal 303. At time $t_1$ the dwell signal transits active. Responsive to this, the sustaining voltage gate and isolation circuit 307 provides the gated sustaining voltage 405. Since the spark gap 610 is not ionized the sustaining voltage just sits across the gap 609. This is shown at reference number 407 on the spark plug voltage waveform 319. Coincidentally the delay circuit 321 of the core driver 311 is initiated. At time $t_2$ the one-shot 323 is initiated and drives the driver 325 with the spark command signal 317. The driver 325 then powers the conductor 133 surrounding the ferrite core 121. This creates a magnetic field between the ferrite core 121 and the cup core 103, thereby compressing the stack of piezoelectric crystals 129, and generating a very high voltage as illustrated in the spark plug voltage waveform 319 by reference number 409. This very high voltage, when delivered through the ignition voltage isolation circuit 313, ionizes the gas in the spark gap 610. Then the spark gap starts to conduct, lowering its resistance dramatically. Because of this, the spark plug voltage 319 falls abruptly back to the level provided by the gated sustaining voltage 405 as shown at reference number 411. At time t3 the one-shot 323 expires, forcing the driver 325 to terminate the spark command signal 317. The stack of piezoelectric crystals 129 then generates a very high voltage of the opposite polarity. Since the sustaining voltage gate and isolation circuit 307 is of a relatively low impedance, the pulse 413 does not substantially affect the spark plug voltage 319. Later a voltage clamping circuit is optionally added to completely eliminate any ill effects of this negative transition. During the time between $t_3$ and $t_4$ the air-fuel mixture in the cylinder is burning. The inclusion of the sustaining voltage supply 305 ensures sufficient energy to completely burn the air-fuel mixture in a lean burn application. Because of the great differences in the voltage and time scales of the various waveforms, the break lines 417 and 419 are provided in order to conveniently show the important aspect of the waveforms. At time $t_4$ the dwell signal transits inactive and the sustaining voltage gate and isolation circuit 307 deselects the sustaining voltage provided by the sustaining voltage power supply 305. This causes the spark plug voltage 319 to fall back to zero volts-thereby extinguishing the spark gap 610. This completes one ignition cycle including the ignition, sustaining of the conduction, and extinguishing of the spark gap 409. This cycle is repeated with every cylinder firing. The next step is to illustrate the details of fabrication of the apparatus described thusfar.

Figure 5:
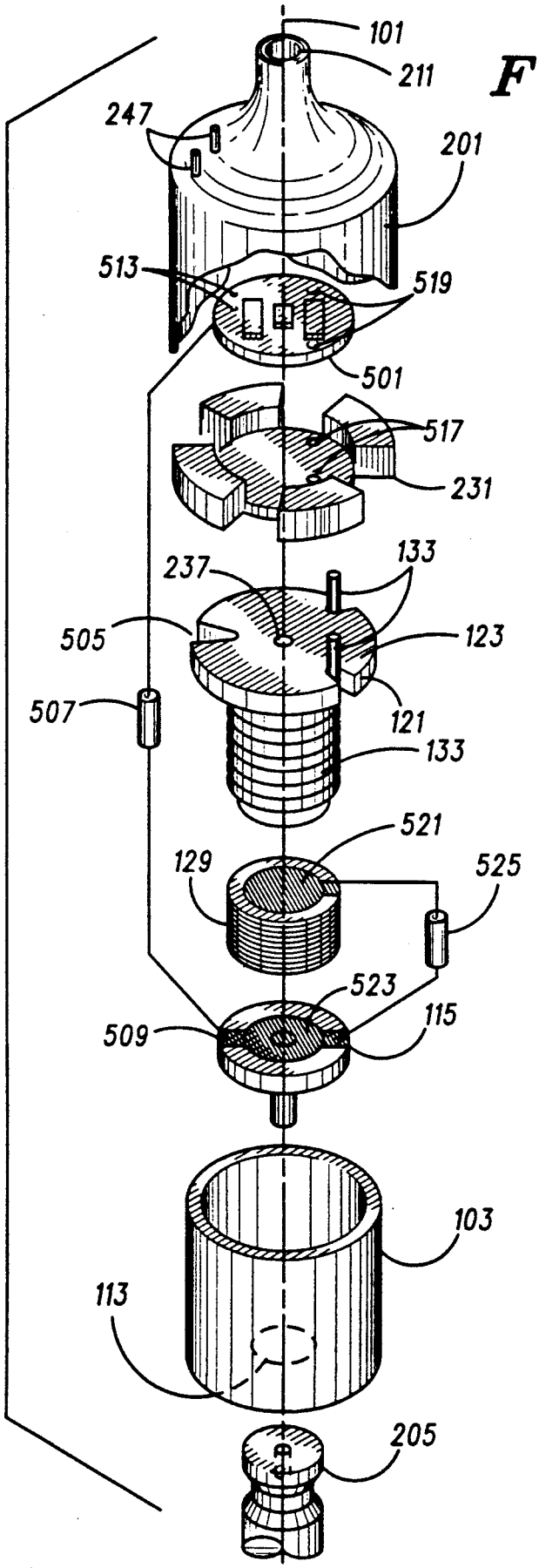
FIG. 5 is an exploded view showing the construction of the apparatus illustrated in FIG. 3.

FIG. 5 is an exploded view showing the construction of the apparatus illustrated in schematic block diagram form in FIG. 3. Note that a substrate 501 holds the circuitry described in blocks 305, 307, and 311 of FIG. 3. Starting with the cup core element 103 the insulating spacer 115 is disposed through the feedthrough aperture 113. Then a, high peak inverse voltage, silicon diode 507 is connected to a pad 509 on the surface of the insulating spacer 115. This is done with a conductive adhesive. In the preferred embodiment ABLESTICK 8175 epoxy based adhesive with a conductive filler is used. Alternatively a soldering process may be used. This diode 507 serves to isolate the ignition voltage from the sustaining voltage gate internal to the and sustaining voltage gate and isolation circuit 307. Then an electrically resistive adhesive 523 is disposed on the spacer 115. The electrical resistivity of the adhesive 523 provides the ignition voltage isolation suggested in block 313 in FIG. 3. The material used is also ABLESTICK 8175. The resistivity of the adhesive applied here is on the order of 1,000 ohms. The stack of piezoelectric crystals 129 is then disposed on the adhesive 523. An electrically conductive adhesive 521 is disposed on the top of the stack of piezoelectric crystals 129, and the ferrite core 121 is disposed onto the electrically conductive adhesive 521. The material used is also ABLESTICK 8175. Note that the silicon diode 507 extends through a slot 505 in the ferrite core 121. Next, a clamping diode 525 is attached across the stack of piezoelectric crystals. Along with the resistive adhesive 523 this circuit will clamp the negative transition from the ignition generator. This diode 525 is attached with the same ABLESTICK 8175 material. The heatsink 229 is then disposed on the top surface of the ferrite core 123. Note the two holes 517 for receiving the conductor 133, and allowing it to protrude through the heatsink 229. Note also the selective portions 231 protruding from the heatsink 229. The diode 507 is then connected to a circuit substrate 501 by the ABLESTICK 8175 conductive adhesive. As mentioned earlier this circuit substrate holds the circuitry represented in FIG. 3 in blocks 305, 307, and 311. This circuitry uses the heatsink 229 to dissipate any excess power.

Note the two holes 519 for receiving the conductor 133, and allowing it to protrude through and connect to the circuit substrate 501.

Two holes 513 are provided in the circuit substrate 501 for connecting to the two terminals 247 for receiving battery power for powering the internal circuitry.

The completed assembly is then inserted into a mold having a form simulating a spark plug on the cup core 103 side and an optical cable 211 on the circuit substrate 501 side. Then a silicone material is injected under a vacuum. This silicone material surrounds and permeates the assembly.

Next the conductive material, in this case the Wacker silver filled silicone material, is sprayed on the exterior surface 207 creating the electromagnetic shield 203, the connected negative mating area 217 creating the negative terminal 221, and the positive mating area 223 creating the positive terminal 205.

The exact sequence of assembly may vary and is not critical to the operation of the apparatus.

FIG. 6 is a cross section of the apparatus shown in FIG. 5 assembled and attached to a spark plug.

Those of ordinary skill in the art will recognize many variations that can exploit the advantages of this concept including; construction of a spark plug with an integral apparatus as described herein, or a centralized sustaining voltage supply for driving several ignition apparatus in multi-cylinder application. These and other variations of this useful apparatus are considered to be equivalent to the apparatus disclosed herein.

By combining a piezoelectric element, integral to a magnetic field, to generate an ignition voltage, and a sustaining voltage supply, to provide the necessary sustaining energy, an improved apparatus for lighting air-fuel mixtures in an internal combustion engine is provided.

This apparatus is energy efficient because the energy is converted to the appropriate voltages only when it is needed and at maximum efficiency because of the construction of the magnetic elements 103, 121, and 133. The construction of the magnetic elements 103, 121, and 133 provides a volumetrically efficient design for electromechanically transforming electrical energy into mechanical displacement. The insertion of the stack of piezoelectric crystals 129 within the magnetic field affords no mechanical coupling loss. Further, the inclusion of the sustaining voltage supply ensures sufficient energy to completely burn the air-fuel mixture in a lean burn application. The replacement of the autotransformer by a piezoelectric element eases the power burden on the driving circuitry and ensures a higher quality of energy provided to the spark gap.

Further, an elastomeric boot has been described, providing electromagnetic shielding, sealing, and a lightweight-compact package for mounting on a spark plug. Of course, it would be obvious to construct a spark plug with an integral apparatus as described herein.

What is claimed is:

1. An ignition apparatus for providing energy to a spark plug comprising:

electromagnetic means having a north pole and an opposing south pole, said electromagnetic means having an opening formed therein;

insulating means disposed between the north pole and the opposing south pole, said insulating means having a feedthrough aperture disposed therethrough extending through the opening of said electromagnetic means; and piezoelectric crystal means for producing energy, wherein said piezoelectric crystal means is located in contact with said insulating means and between said poles, and wherein said electromagnetic means, in response to electrical excitation, compresses said piezoelectric crystal means, thereby causing an ignition energy to be provided from said piezoelectric crystal means through the feedthrough aperture of said insulating means and through the opening of said electromagnetic means for igniting said spark plug.

2. An apparatus in accordance with claim 1 wherein said piezoelectric crystal means is comprised of a stack of connected piezoelectric crystals, thereby causing energy to be produced by said piezoelectric crystal means representative of the number of piezoelectric crystals in the stack.

3. An apparatus in accordance with claim 1 wherein said piezoelectric crystal means is aligned normal with and intersecting a magnetic field produced in said electromagnetic means in response to electrical excitation.

4. An ignition apparatus for providing energy to a spark plug comprising:

electromagnetic means having a north pole and an opposing south pole;

piezoelectric crystal means for producing energy, wherein said piezoelectric crystal means is located between said poles, and wherein said electromagnetic means, in response to electrical excitation, compresses said piezoelectric crystal means, thereby causing an ignition energy to be provided from said piezoelectric crystal means for igniting said spark plug; and a substantially tubular electrically insulating elastomeric boot for housing said electromagnetic means and said piezoelectric crystal means, wherein said boot has an electromagnetic shield disposed thereon, said housed electromagnetic means and said piezoelectric crystal means are to be connected to said spark plug.

5. An ignition apparatus for providing energy to a spark plug having a predominant axis comprising:

cup core means having a predominantly tubular geometry of a predetermined diameter located longitudinally along said axis, said cup core means having an open end bounded by a top edge, and a substantially closed end, wherein the substantially closed end is oriented perpendicular with said axis, and wherein the substantially closed end has an inside surface and an opposing outside surface with an aperture disposed therein, the aperture having a predetermined diameter, smaller than the predetermined diameter of said cup core means, emanating away from said axis and originating on the inside surface and continuing to the opposing outside surface;

insulating means disposed on the inside surface of said cup core means and protruding through the aperture and extending away from the opposing outside surface, said insulating means having a feedthrough aperture disposed therein emanating away from said axis and originating away from the opposing outside surface of said cup core means and continuing to a top surface of said insulating means;

ferrite core means having a top surface and an opposing bottom surface, the surfaces located parallel to, and the opposing bottom surface spaced apart from, the top edge of said cup core means, for providing an electrically insulating gap, wherein a protruding member extends away from the opposing bottom surface parallel to said axis; and piezoelectric crystal means disposed between the top surface of said insulating means and the protruding member of said ferrite core means, said piezoelectric crystal means for providing energy to said spark plug responsive to being compressed between the top surface of said insulating means and the protruding member of said ferrite core means.

6. An apparatus in accordance with claim 5 wherein said piezoelectric crystal means is comprised of a stack of connected piezoelectric crystals, thereby causing energy to be produced by said piezoelectric crystal means representative of the number of piezoelectric crystals in the stack.

7. An apparatus in accordance with claim 5 wherein the feedthrough aperture disposed into said insulating means has an electrically conductive material disposed therein for conducting said energy to said spark plug.

8. An apparatus in accordance with claim 7 further comprising an substantially tubular, electrically insulating, elastomeric boot for housing said apparatus, wherein said boot has an electromagnetic shield disposed thereon, and wherein said boot has an electrically conductive positive mating area disposed adjacent to said electrically conductive material disposed in said insulating means, for providing said energy to said spark plug.

9. An apparatus in accordance with claim 5 wherein the protruding member is comprised of a substantially cylindrical element.

10. An apparatus in accordance with claim 5 wherein the protruding member of the ferrite core means includes a conductor disposed as a plurality of windings thereon.

11. An apparatus in accordance with claim 8 wherein in response to excitation of said conductor a magnetic field is provided including said ferrite core means, the electrically insulating gap, said cup core means, said insulating means, and said piezoelectric crystal means, said magnetic field causing the opposing bottom surface of said ferrite core means, to attract towards the top edge of said cup core means and the inside surface of the substantially closed end of said cup core means to attract towards the protruding member of said ferrite core means thereby compressing said piezoelectric crystal means, wherein said piezoelectric crystal means, in response to said compression, provides energy to said spark plug.

12. An apparatus in accordance with claim 11 wherein said piezoelectric crystal means is aligned normal with and intersecting the magnetic field produced in said apparatus in response to electrical excitation.

13. An apparatus in accordance with claim 5 wherein said insulating means is comprised of a ceramic material.

14. A spark plug boot assembly for providing energy to a spark plug comprising:

a boot having an exterior surface with a conductive material disposed thereon, said boot having a cable end portion for receiving an ignition cable, a plug portion for receiving said spark plug, the plug portion having an interior surface with a negative mating area, the negative mating area having a conductive material disposed thereon, the conductive material connected to the conductive material disposed on the exterior surface of said boot, the negative mating area providing a negative terminal to be connected to said spark plug, a positive mating area having a conductive material disposed thereon, the positive mating area located apart from and electrically isolated from the negative terminal and providing a positive terminal to be connected to said spark plug, and an interior cavity portion located between the cable end portion and the plug portion;

electrically conductive heatsink means disposed into the interior cavity portion and having selective portions protruding through the exterior surface of said boot, wherein the selective portions are electrically connected to the conductive material disposed on the exterior surface of said boot;

ferrite core means having a top surface disposed on a portion of said heatsink means, said ferrite core means having an electrically conductive portion disposed thereinto, wherein the conductive portion is electrically connected to said heatsink means;

cup core means located in the interior cavity portion of said boot predominantly surrounding and spaced apart from said ferrite core means for providing an electrically insulating gap, said cup core means having a predominantly tubular geometry of a predetermined diameter with an open end and a substantially closed end, wherein the substantially closed end is located adjacent to the positive terminal of said boot, and wherein the substantially closed end has an inside surface and an opposing outside surface with an aperture disposed therein, the aperture having a predetermined diameter, smaller than the predetermined diameter of said cup core means, originating on the inside surface and continuing to the opposing outside surface;

insulating means disposed on the inside surface of the substantially closed end of said cup core means and protruding through the aperture and extending towards the positive terminal of said boot, said insulating means having a feedthrough aperture disposed therein originating away from the opposing outside surface of said cup core means and continuing to a top surface of said insulating means, the feedthrough aperture having an electrically conductive material disposed therein and electrically connected to the positive terminal of said boot; and piezoelectric crystal means coupled between the conductive portion, disposed into said ferrite core means, and the electrically conductive material of said insulating means, wherein an electrical connection is provided at each of the couplings, and wherein said piezoelectric crystal means, responsive to a compression provided between said ferrite core means and said insulating means, provides an ignition energy through an electrical path including the electrically conductive material, the positive terminal of said boot, said spark plug, the negative terminal of said boot, the electrically conductive heatsink means, the conductive portion disposed into said ferrite core means and said piezoelectric crystal means.

15. An apparatus in accordance with claim 14 wherein said piezoelectric crystal means is comprised of a stack of connected piezoelectric crystals, thereby causing energy to be produced by said piezoelectric crystal means representative of the number of piezoelectric crystals in the stack.

16. An apparatus in accordance with claim 15 wherein in response to excitation of a conductor surrounding said ferrite core means a magnetic field is provided including said ferrite core means, the electrically insulating gap, cup core means, the electrically conductive material, and said piezoelectric crystal means, said magnetic field causing said ferrite core means to attract towards said cup core means thereby compressing said piezoelectric means, said piezoelectric crystal means, in response to said compression, provides energy to said spark plug.

17. An apparatus in accordance with claim 14 wherein said insulating means is comprised of a ceramic material.

18. An ignition apparatus for providing energy to a spark plug comprising:

electromagnetic means having a north pole and an opposing south pole, said electromagnetic means having, an opening formed therein;

insulating means disposed between the north pole and the opposing south pole, said insulating means having a conductive feedthrough aperture disposed therethrough extending through the opening of said electromagnetic means;

piezoelectric crystal means for producing energy, wherein said piezoelectric crystal means is located between said poles, and wherein said electromagnetic means, in response to electrical excitation, compresses said piezoelectric crystal means, thereby causing an ignition energy to be provided from said piezoelectric crystal means;

sustaining energy means for providing a sustaining energy; and combining means, coupled to the conductive feedthrough aperture of said insulating means, for combining the ignition energy provided by said piezoelectric crystal means and the sustaining energy provided by said sustaining energy means and providing a combined energy to ignite and sustain ignition of said spark plug.

19. An apparatus in accordance with claim 18 wherein said means for combining further comprises a first means for isolating the ignition energy from the sustaining energy.

20. An apparatus in accordance with claim 19 wherein said first means for isolating comprises a semiconductor diode.

21. An apparatus in accordance with claim 18 wherein said sustaining energy means is comprised of a voltage amplifier for providing amplification of a to be provided battery voltage.

22. An apparatus in accordance with claim 18 further comprising a second means for isolating the sustaining energy from the ignition energy.

23. An apparatus in accordance with claim 22 wherein said second means for isolating comprises a resistive means.

24. An ignition apparatus for providing energy to a spark plug comprising:

electromagnetic means having a north pole and an opposing south pole;

piezoelectric crystal means for producing energy, wherein said piezoelectric crystal means is located between said poles, and wherein said electromagnetic means, in response to electrical excitation, compresses said piezoelectric crystal means, thereby causing an ignition energy to be provided from said piezoelectric crystal means sustaining energy means for providing a sustaining energy; and means for combining the ignition energy provided by said piezoelectric crystal means and the sustaining energy provided by said sustaining energy means and providing a combined energy to ignite and sustain ignition of said spark plug; and a substantially tubular electrically insulating elastomeric boot for housing said electromagnetic means, said piezoelectric crystal means, said sustaining energy means, and said means for combining, wherein said boot has an electromagnetic shield disposed thereon, said housed electromagnetic means, said piezoelectric crystal means, said sustaining energy means, and said means for combining are to be connected to said spark plug, and wherein the electromagnetic shield is to be electrically connected to a negative terminal of said spark plug.

25. A spark plug boot assembly for providing energy to a spark plug comprising:

a substantially tubular elastomeric boot having an exterior surface with an electrically conductive material disposed thereon, said boot having a cable end portion for receiving an ignition cable, a plug portion for receiving said spark plug, the plug portion having an interior surface with a negative mating area, the negative mating area having an electrically conductive material disposed thereon, the electrically conductive material connected to the electrically conductive material disposed on the exterior surface of said boot, the negative mating area providing a negative terminal to be connected to said spark plug, a positive mating area having an electrically conductive material disposed thereon, the positive mating area located apart from and electrically isolated from the negative terminal and providing a positive terminal to be connected to said spark plug, and an interior cavity portion located between the cable end portion and the plug portion;

electrically conductive heatsink means disposed into the interior cavity portion and having selective portions protruding through the exterior surface of said boot, wherein the selective portions are electrically connected to the conductive material disposed on the exterior surface of said boot;

ferrite core means having a top surface disposed on a portion of said heatsink means, said ferrite core means having an electrically conductive portion disposed thereinto, wherein the conductive portion is electrically connected to said heatsink means;

cup core means located in the interior cavity portion of said boot predominantly surrounding and spaced apart from said ferrite core means for providing an electrically insulating gap, said cup core means having a predominantly tubular geometry of a predetermined diameter with an open end and a substantially closed end, wherein the substantially closed end is located adjacent to the positive terminal of said boot, and wherein the substantially closed end has an inside surface and an opposing outside surface with an aperture disposed therein, the aperture having a predetermined diameter, smaller than the predetermined diameter of said cup core means, originating on the inside surface and continuing to the opposing outside surface;

sustaining energy means for providing a sustaining energy;

insulating means disposed on the inside surface of the substantially closed end of said cup core means and protruding through the aperture and extending towards the positive terminal of said boot, said insulating means having a feedthrough aperture disposed therein originating away from the opposing outside surface of said cup core means and continuing to a top surface of said insulating means, the feedthrough aperture having an electrically conductive material disposed therein and electrically connected to the positive terminal of said boot;

piezoelectric crystal means coupled between the conductive portion, disposed into said ferrite core means, and the electrically conductive material of said insulating means, wherein an electrical connection is provided at each of the couplings, and wherein said piezoelectric crystal means, responsive to a compression provided between said ferrite core means and said insulating means, provides an ignition energy; and means for combining the ignition energy provided by said piezoelectric crystal means and the sustaining energy provided by said sustaining energy means and providing a combined energy to ignite and sustain ignition of said spark plug through an electrical path including; the electrically conductive material, the positive terminal of said boot, said spark plug, the negative terminal of said boot, the electrically conductive heatsink means.

26. An apparatus in accordance with claim 25 wherein said sustaining energy means for providing a sustaining energy is comprised of a voltage amplifier for providing amplification of a to be provided battery voltage.

27. An apparatus in accordance with claim 25 wherein said insulating means is comprised of a ceramic material.

28. An apparatus in accordance with claim 25 wherein said means for combining further comprises a first means for isolating the ignition energy from the sustaining energy.

29. An apparatus in accordance with claim 25 wherein said first means for isolating comprises a semiconductor diode.

30. A spark plug boot assembly for providing energy to a spark plug comprising:

an ignition voltage generator comprising:

a delay circuit for receiving a to be provided dwell signal, a one-shot circuit, responsive to said delay circuit, a driver circuit, responsive to said one-shot for driving a magnetic circuit for compressing a piezoelectric crystal, said crystal generating an ignition voltage, and an ignition voltage isolation circuit for receiving the ignition voltage generated by said piezoelectric crystal;

a sustaining voltage supply comprising:

an amplifier for amplifying a to be provided battery voltage and providing a sustaining voltage, a gate for receiving the sustaining voltage and, responsive to said dwell signal, for providing a gated sustaining voltage, and a sustaining voltage isolation circuit for receiving the sustaining voltage provided by said gate; and means for combining the ignition voltage provided by the ignition voltage isolation circuit and the sustaining voltage provided by the sustaining voltage isolation circuit and providing the combined energy to said spark plug.

31. A piezoelectric ignition system for igniting a spark plug comprising:

an ignition controller for providing a dwell signal;

an ignition boot comprising:

electromagnetic means having a north pole and an opposing south pole;

piezoelectric crystal means for producing energy, wherein said piezoelectric crystal means is located between said poles, and wherein said electromagnetic means, in response to electrical excitation, compresses said piezoelectric crystal means, thereby causing an ignition energy to be provided from said piezoelectric crystal means;

sustaining energy means for providing a sustaining energy;

means for combining the ignition energy provided by said piezoelectric crystal means and the sustaining energy provided by said sustaining energy means and providing a combined energy; and optical connection means for connecting the dwell signal from said ignition controller to said ignition boot, and wherein in response to a dwell signal said combined energy is provided to said spark plug.

* * * * *